US010047621B2

(12) United States Patent
Palazuelos et al.

(10) Patent No.: US 10,047,621 B2
(45) Date of Patent: Aug. 14, 2018

(54) SEALING PLATE WITH FUSE FUNCTION

(71) Applicant: Safran Aircraft Engines, Paris (FR)

(72) Inventors: Raymond Miguel Palazuelos, Moissy-Cramayel (FR); Antoinette Clelia Barbier-Neveu, Moissy-Cramayel (FR); Marie-Guy Devradj Gustave, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/313,521

(22) PCT Filed: May 26, 2015

(86) PCT No.: PCT/FR2015/051386
§ 371 (c)(1),
(2) Date: Nov. 22, 2016

(87) PCT Pub. No.: WO2015/181489
PCT Pub. Date: Dec. 3, 2015

(65) Prior Publication Data

US 2017/0138210 A1 May 18, 2017

(30) Foreign Application Priority Data

May 27, 2014 (FR) ..... 14 54802

(51) Int. Cl.
*F01D 11/00* (2006.01)
*F01D 25/30* (2006.01)
*F01D 25/24* (2006.01)

(52) U.S. Cl.
CPC ..... *F01D 11/003* (2013.01); *F01D 25/243* (2013.01); *F01D 25/30* (2013.01); *F05D 2220/30* (2013.01)

(58) Field of Classification Search
CPC ..... F01D 11/005; F01D 11/003; F01D 11/00
See application file for complete search history.

(56) References Cited

U.S. PATENT DOCUMENTS 4,730,832 A * 3/1988 Cederwall ..... B23P 19/04 277/321
5,143,292 A 9/1992 Corsmeier et al.
(Continued)

OTHER PUBLICATIONS

French Search Report with English Language Translation Cover Sheet, dated Jan. 26, 2015, FR Application. No. 1454802.
(Continued)

*Primary Examiner* — Woody Lee, Jr.
(74) *Attorney, Agent, or Firm* — Womble Bond Dickinson (US) LLP

(57) ABSTRACT

The invention proposes an assembly (1) comprising: an exhaust casing (20), rotating about an axis (X-X), comprising a flange (23) for attachment to a mounting (42); a sealing plate (30) for rotation about the axis, the plate being added to the attachment flange of the casing and having a radial section comprising: a radially inner end portion (32), a radially outer end portion (34), and a bend (31) extending between the two end portions, said portions forming therebetween an angle of 80 to 100 degrees, the outer end portion having a length in an axial direction (L34) equal to 15% to 35% of the height (H) of the plate measured in the radial direction around the rotation axis, the outer end portion extending parallel to said axis, and said bend being open in the downstream direction relative to the flow of air.

10 Claims, 3 Drawing Sheets

(56) References Cited

U.S. PATENT DOCUMENTS

| | | | | |
|---|---|---|---|---|
| 6,287,091 | B1 * | 9/2001 | Svihla | F01D 9/023 415/170.1 |
| 9,845,695 | B2 * | 12/2017 | Budnick | F01D 11/003 |
| 2004/0219014 | A1 * | 11/2004 | Synnott | F01D 9/041 415/209.2 |
| 2007/0025841 | A1 * | 2/2007 | Milazar | F01D 11/005 415/134 |
| 2007/0113550 | A1 * | 5/2007 | Sausee | F01D 9/026 60/598 |
| 2008/0061515 | A1 | 3/2008 | Durocher et al. | |
| 2009/0155071 | A1 * | 6/2009 | Lescure | F01D 11/005 415/214.1 |
| 2012/0023897 | A1 * | 2/2012 | Dede | F02C 7/25 60/39.094 |
| 2012/0027584 | A1 | 2/2012 | Cummins et al. | |
| 2013/0230386 | A1 | 9/2013 | Baumann et al. | |
| 2013/0236305 | A1 * | 9/2013 | Hashimoto | F01D 11/003 415/230 |
| 2014/0248128 | A1 * | 9/2014 | Budnick | F01D 11/005 415/111 |

OTHER PUBLICATIONS

International Search Report with English Language Translation, dated Sep. 15, 2015, PCT Application. No. PCT/FR2015/051386.

* cited by examiner

SEALING PLATE WITH FUSE FUNCTION

FIELD OF THE INVENTION

The field of the invention is that of turbine engine sealing plates and turbine engines comprising such plates.

PRIOR ART

In reference to FIG. 1*a*, a turbine engine T conventionally comprises a high-pressure turbine 2 and a low-pressure turbine 3.

The low-pressure turbine comprises several turbine stages, including at least one rotor stage 4, i.e., moving vane assembly, and a stator stage 5, i.e., fixed vane assembly for distribution of airflow flowing in the turbine.

The final stage of the turbine is a rotor stage which is followed downstream relative to the airflow in the turbine engine by a fixed vane assembly called exhaust casing 6, which straightens the airflow before it is evacuated into the atmosphere via nozzles. Gases circulate from upstream to downstream, from left to right in FIGS. 1*a* and 1*b*.

To ensure aeronautic performance of the turbine engine, and as seen in FIG. 1*b*, the exhaust casing 6 comprises a spoiler 60 extending to upstream of the casing relative to the airflow in the passage.

This spoiler cooperates with a sectored downstream spoiler assembly 40 of the final rotor stage 4 to form a dynamic seal, preventing air flowing in the passage of the turbine from flowing towards the space located under the spoilers, and vice versa.

The sealing is achieved by natural retreat of the final rotor stage during operation, which guides the downstream spoiler of the rotor to be superposed on the upstream spoiler of the exhaust casing in the direction of the axis of revolution of the turbine engine. As the downstream spoiler 40 is an assembly of sectored pieces juxtaposed on 360° and the spoiler 60 is a monobloc piece, both are considered as two pieces rotating about this axis, and the result is not only axial but also circumferential coverage of both spoilers 40, 60.

In the case of overspeed of the final rotor stage of the turbine, retreat of this stage can be greater than its normal retreat and creates contact between the upstream spoiler of the exhaust casing and the rotor stage.

For maximum preservation of the integrity of the turbine engine in such a case, a hierarchy of rupture of pieces is provided, allowing especially for the upstream spoiler of the exhaust casing not having to oppose resistance to the rotor stage and break or fold as soon as possible in the event of contact with the rotor.

This capacity to break or fold first in case of contact is qualified as a "fuse" function of the piece.

As evident in FIG. 1*b*, the current geometry of the upstream spoiler of the exhaust casing fails to ensure this fuse function as this spoiler is too robust to fold in case of contact for the rotor.

This geometry is therefore unsatisfactory from the viewpoint of safety of use of the turbine engine.

PRESENTATION OF THE INVENTION

The aim of the invention is to eliminate the disadvantages of the prior art by proposing an element for ensuring sealing between the exhaust casing and a rotor stage, and having a fuse function.

In this respect, the aim of the invention is an assembly comprising:

an exhaust casing, said casing being of revolution about a turbine engine drive shaft, and comprising a fastening flange to a support, and a sealing plate of revolution around the axis, characterized in that the plate is attached on the fastening flange of the exhaust casing, and has a radial section comprising:

a radially internal end part, a radially external end part, and an elbow extending between the two end parts, said parts together forming an angle comprised between 80 and 100 degrees, and the radially external end part having a length in an axial direction comprised between 15 and 35% of the height of the plate measured in the radial direction around the axis of revolution, and the radially external end part extending substantially parallel to said axis, and in that said elbow is angularly open to downstream in the axial direction relative to the airflow in the turbine engine.

Some preferred but non-limiting characteristics of the assembly described hereinabove are the following:

- the end parts of the plate together form an angle of 90 degrees, the radially internal end part extending substantially radially relative to the axis of revolution of the plate,
- the plate further comprises an intermediate part, the elbow connecting the radially external end part and the intermediate part together, the plate further comprising a second elbow connecting the intermediate part and the radially internal end part together,
- and the radially internal end part of the plate has a length comprised between 25 and 45% of the height of the plate measured in the radial direction around the axis of revolution,
- the radially external end part of the plate has a mid-point substantially aligned with the radially internal end part,
- the intermediate part of the plate comprises a radially internal portion, a radially external portion, and an elbow forming a third elbow of the plate, said elbow connecting together the internal and external portions, the first and the second elbow being open towards the same side of the plate relative to the axis, and the third elbow being open towards the opposite side,
- the first elbow of the plate forms an angle, between the external end part and the external portion of the intermediate part, between 5 and 15 degrees, and the third elbow forms an angle, between the two portions of the intermediate part, comprised between 60 and 80 degrees,
- the first elbow and the third elbow of the plate correspond to ends in the axial direction of the plate, and the distance, measured in the axial direction, between the first elbow and the radially internal end part, corresponds substantially to a quarter of the distance, measured in the axial direction, between the first and the third elbow.
- the casing comprises a protruding spoiler extending parallel to the axis, to upstream of the casing relative to the airflow, and the third elbow of the plate is downstream of the spoiler relative to the airflow,
- the assembly further comprises a casing support, the casing being fixed to the casing support by the fastening flange, and the plate of revolution being fixed between the flange and the casing support, and
- the height of the plate is comprised between 15 and 35% of the distance between the axis of revolution (Y-Y) and the radially external end part of the plate.

According to a second aspect, the invention also proposes a turbine engine comprising an assembly as described hereinabove.

The sealing plate according to the invention has a geometry for producing both sealing between the exhaust casing and a turbine stage, and a role as fuse.

In fact, the first elbow of the plate creates an external end portion with superposition in the axial direction both with the upstream spoiler of the exhaust casing and the downstream spoiler of the rotor stage.

This geometry also lends flexibility to the plate, letting it retreat downstream relative to the flow of air in the turbine engine, in case of excessive retreat of the rotor, while preserving the casing. In this way it ensures a fuse role.

The second elbow geometrically readjusts the external part of the plate relative to the flanging point.

Finally, stiffening the plate has the third elbow modify its special vibration frequencies to remove them from the operating frequencies of the turbine engine. A metal sheet with three elbows is in fact more rigid than a metal sheet having two elbows only.

DESCRIPTION OF THE FIGURES

Other characteristics, aims and advantages of the invention will emerge from the following description which is purely illustrative and non-limiting and which must be considered in conjunction with the appended drawings, in which.

DETAILED DESCRIPTION OF AT LEAST ONE EMBODIMENT OF THE INVENTION

Conventionally, gases flow from upstream to downstream through a turbine engine, or from left to right in the illustrations of the present application.

Figure 3A:
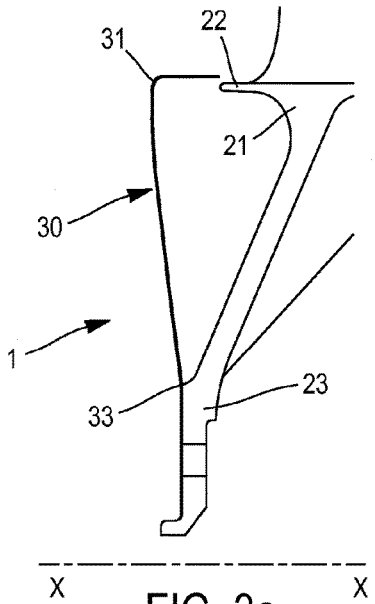
FIGS. 3*a* and 3*b* show a view in radial section of a turbine engine assembly comprising an exhaust casing and a plate, respectively according to the embodiments of FIGS. 2*a* and 2*b*.
Figure 3B:
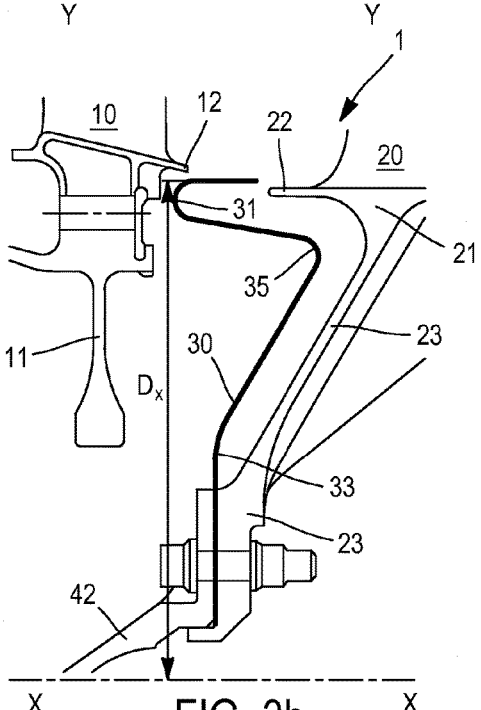

FIGS. 3*a* and 3*b* illustrate a turbine engine assembly 1 comprising a low-pressure turbine rotor stage 10 (seen in FIG. 3*b*) and an exhaust casing 20, these two pieces rotating about an axis X-X of the turbine engine, shown schematically to illustrate the directions relative to this axis, the exhaust casing being placed downstream of the rotor stage relative to the airflow in the turbine engine.

To ensure sealing of the passage of the rotor stage, by a component also ensuring a fuse function, the turbine engine assembly also comprises a sealing plate 30 which is attached to the exhaust casing.

This plate is a piece made in one single piece of material, of revolution about an axis Y-Y which, when the plate is mounted in the assembly, is coincident with the rotating axis X-X of the turbine engine.

The plate can be made by turning or by stamping and is advantageously made of Hastelloy® X.

Figure 1A:
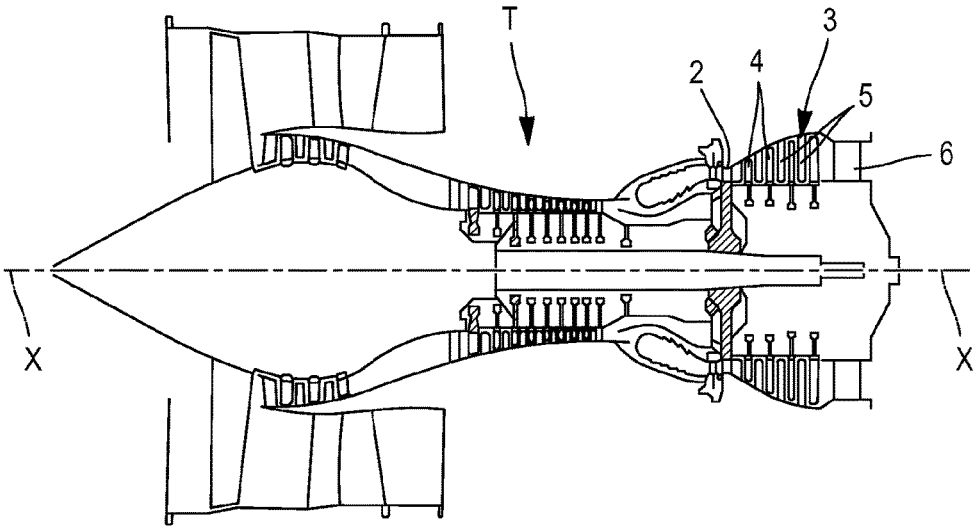
FIG. 1*a*, already described, schematically illustrates an example of a turbine engine, FIG. 1*b*, already also described, shows a view in partial section of a turbine engine at an exhaust casing.
Figure 1B:
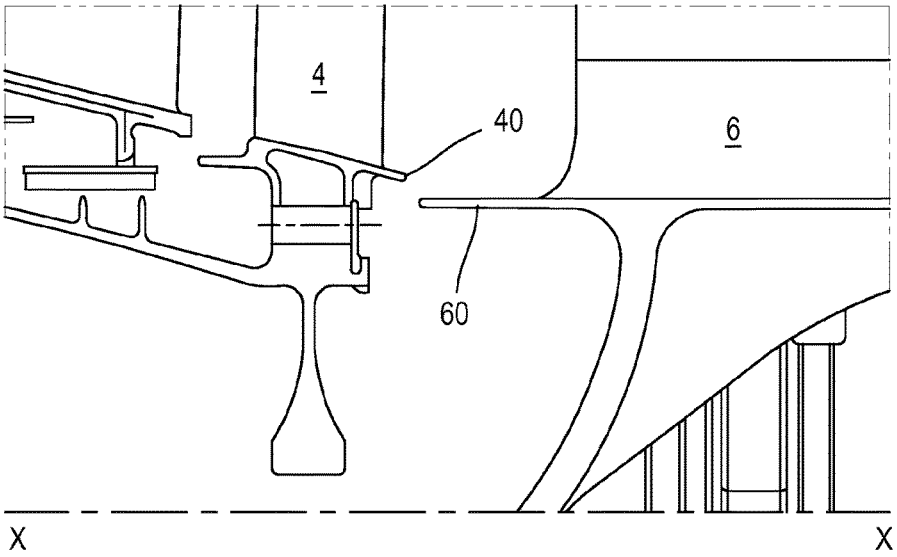
Figure 2A:
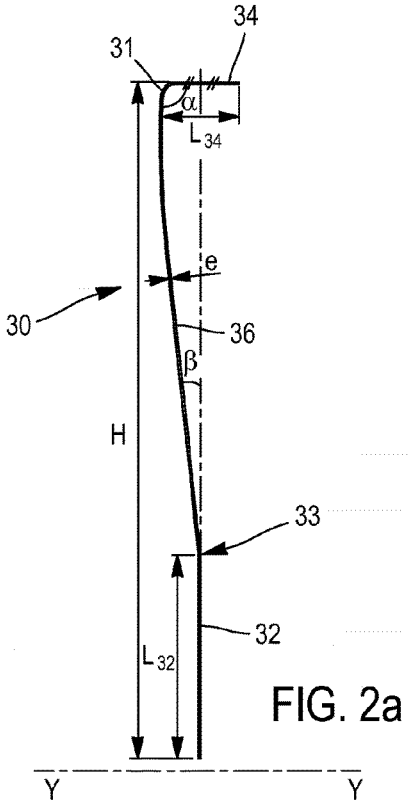
FIGS. 2*a* and 2*b* show a view in radial section of two embodiments of a plate.
Figure 2B:
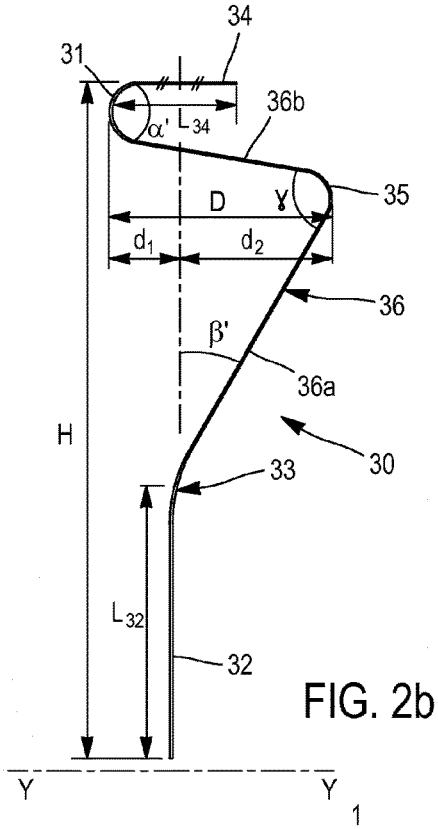

FIGS. 2*a* and 2*b* show a view in radial section of such a plate, according to two embodiments, the second embodiment being preferred.

The plate comprises a radial section identical over its entire circumference.

The radial section of the plate comprises a radially internal end part 32, and a radially external end part 34, these two parts together forming an angle comprised between 80 and 100 degrees, and advantageously equal to 90 degrees.

According to a preferred embodiment, the radially internal end part 32 extends substantially radially relative to the axis of revolution of the plate, and the radially external end part 34 extends substantially parallel to this axis. As described hereinbelow, when the plate is fixed in an assembly 1, the external end part 34 of the plate extends parallel to the axis of rotation X-X of the turbine engine and it can be superposed on an upstream spoiler of the exhaust casing.

Back to FIGS. 2*a* and 2*b*, the plate also comprises a first elbow 31 extending between the two end parts.

The radially external end part 34 has a length $L_{34}$ comprised between 15 and 35% of the height H of the plate, measured in the radial direction relative to the axis of revolution. Advantageously, the length in the axial direction $L_{34}$ of the part 34 is comprised between 18 and 25%, for example of the order of 20% of the height of the plate.

The plate further has minimal thickness, letting it easily deform to ensure its fuse function. Advantageously, the thickness e of the plate is less than 0.5 mm, preferably comprised between 0.3 and 2 mm.

Advantageously, as seen in FIGS. 2*a* and 2*b*, the plate 30 further comprises an intermediate part 36, and a second elbow 33.

The intermediate part 36 is disposed between the end parts 32, 34, and the first elbow 33 connects the intermediate part 36 to the radially external end part 34, and the second elbow 33 connects the intermediate part 36 to the radially internal end part 32.

This second elbow 33 geometrically readjusts the external part of the plate 30 relative to the flanging point by compensating axial offsets. As a variant, the plate 30 could therefore be fitted with a radial part devoid of elbow 33, giving it a general L-shape.

Between the end and the second elbow 33, the radially internal end part 32 has a length in the radial direction $L_{32}$ comprised between 25 and 45% of the total height H of the plate 30 measured in the radial direction, and advantageously of the order of 30 to 35%.

The two elbows 31, 33 of the plate 20 are open towards opposite sides relative to the radial direction around the axis of revolution of the plate, i.e., the centres of curvature of the plate at both elbows are on both sides of a radial direction around the axis.

Preferably, the plate is conformed such that the radially external end part 34 has a midpoint substantially aligned with the radially internal end part 32, the alignment therefore being in a radial direction relative to the axis. In an embodiment, the extension in a radial direction of part 32 intersects the part 34 into a point such that the length $L_{34}$ in the axial direction is distributed at 47% upstream and 53% downstream.

This is achieved for example for values of angles as follows:

the angle $\alpha$ of the first elbow 31, measured as in FIG. 2*a* between the radially external end part 34 and the intermediate part 36, is comprised between 80 and 100°, and the angle β of the second elbow 33, measured between the intermediate part 36 and the radial direction relative to the axis, is comprised between 0 and 20°.

According to an alternative embodiment shown in FIG. 2*b*, the intermediate part 36 of the plate 30 comprises a radially internal portion 36*a* and a radially external portion 36*b*, and an elbow 35 connecting these two portions, this elbow forming a third elbow 35 for the plate 30.

In this embodiment, the first and second elbows 31, 33 are open towards the same side relative to the radial direction relative to the axis, and the third elbow 35 is open towards the opposite side.

The first elbow 31 forms an angle α', measured as in FIG. 2*b* between the radially external end part 34 and the external portion 36*b* of the intermediate part, comprised between 5 and 15 degrees, preferably equal to 10°.

The second elbow 33 forms an angle β', measured between the radial direction and the internal portion 36*a* of the intermediate part 36, comprised between 10 and 40 degrees, preferably 30 degrees.

The third elbow 35 forms an angle γ, measured between the two portions 36*a*, 36*b* of the intermediate part 36, comprised between 60 and 80°, preferably equal to 70°.

Advantageously, the plate is conformed so that the radially external end part 34 always has a midpoint aligned with the radially internal end part 32. In an exemplary embodiment, the extension in a radial direction of part 32 intersects the part 34 into a point such that the length $L_{34}$ in the axial direction is distributed at 47% upstream and 53% downstream.

Also, in the axial direction, the plate 30 has two ends corresponding respectively to the first and third elbow 31, 35. Advantageously, the distance $d_1$, measured in the axial direction, between the first elbow 31 and the radially internal end part 32, corresponds substantially to a quarter of the distance D, measured in the axial direction, between the first 31 and the third elbow 33. Consequently the distance $d_2$, measured in the axial direction, between the radially internal end part 32 and the third elbow 35 corresponds to three quarters of the distance between the first 31 and the third 35 elbow. The ratios $d_1/D$ and $d_2/D$ defined previously have a margin of the order of 20%, or $0.2 \leq d_1 \leq 0.3$ and $0.7 \leq d_2/D \leq 0.8$, given that $d_1+d_2=D$.

In reference to FIGS. 3*a* and 3*b*, an assembly 1 of a turbine engine T comprising such a plate 30 will now be described.

This assembly comprises an exhaust casing 20, comprising a plurality of fixed vanes mounted on a support ring 21. The casing further comprises a circumferential spoiler 22 extending upstream of the ring and the vanes relative to the airflow in the turbine engine.

The assembly further comprises a moving vane assembly 10, forming a rotor stage of the turbine engine. This vane assembly comprises a plurality of vanes mounted on a support ring 11.

This vane assembly further comprises an assembly of sectored spoilers (one spoiler per vane) forming a spoiler 12 extending downstream from the ring and the vanes relative to the direction of the airflow in the turbine engine.

The assembly further comprises an exhaust casing support 42. The exhaust casing comprises a fastening flange 23, by which the casing is mounted on the support 42 by bolting.

Finally, the assembly comprises a plate 30 which is attached on the casing at the fastening flange. The fact that the plate has a substantial radial extension and is connected to the casing at the fastening flange gives it considerable flexibility.

Advantageously, to limit the number of boreholes in the fastening flange, the plate is advantageously mounted by being clamped between the flange and the support 42.

Once it is in place, the height H (taken according to the radial direction relative to the axis X-X) of the plate is comprised between 15 and 35% of the distance $D_x$ between the axis of revolution X-X and the radially external end part of the plate.

With the sealing plate creating sealing of the passage, the spoiler of the casing has no need to present a sizeable axial extension to be superposed on the downstream spoiler of the rotor while it is operating. Consequently, the upstream spoiler of the casing can have reduced axial extension of up to 50% relative to the prior art.

Finally, the first elbow 31 of the plate is angularly open to downstream relative to the airflow in the turbine engine, and the plate is dimensioned so that, in the radial direction, the upstream spoiler 22 of the casing 20 is located radially internally relative to the radially external end part 34 of the plate 30, and advantageously opposite the first elbow in the axial direction. This lets the plate 30 retreat towards the exhaust casing 20 in the event of contact of the rotor stage, without as such making contact with the casing.

In the embodiment where the plate comprises two elbows 31, 33 (FIG. 2*a*), the second elbow 33 is then angularly open to upstream relative to the airflow.

It is therefore evident that the geometry of the plate is advantageous during operation of the turbine engine, for the following aspects:

the radially external end part ensures sealing of the passage of the rotor since, when it is operating, it is superposed axially and circumferentially on a rotor downstream spoiler and the rotor upstream spoiler, the flexibility of the plate lets it fulfil a fuse role in case of overspeed of the rotor, which causes excessive displacement of the latter.

In the embodiment where the plate comprises a third elbow 35 (FIG. 2*b*), this elbow is angularly open to upstream relative to the flow, while the second elbow 33 is open to downstream. The third elbow 35 is advantageously positioned, as in FIG. 3*b*, radially internally relative to the upstream spoiler 22 of the exhaust casing 20, i.e., in reference to FIG. 3*b*, under the spoiler (turned towards the axis X-X) in a radial direction, and downstream of the spoiler 22 relative to the airflow.

The third elbow 35 stiffens the plate 30, which modifies its special frequencies to remove it from the operating frequencies of the engine. This avoids excessive vibrations of the plate when the turbine engine is operating.

Figure 3C:
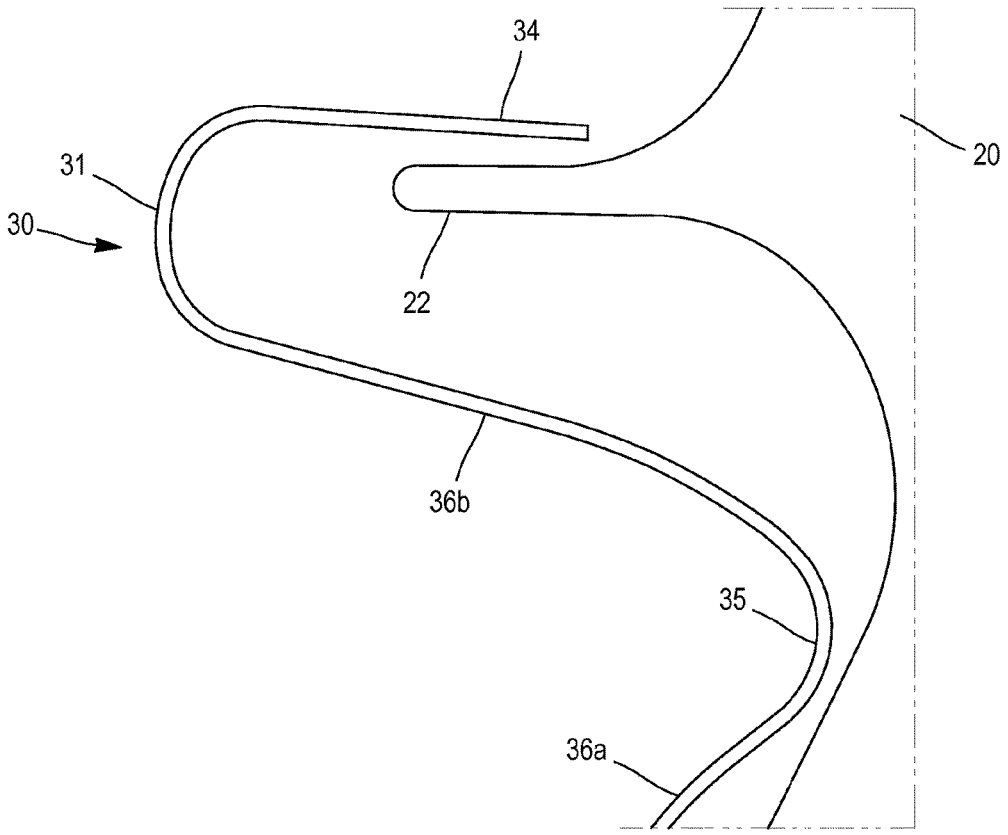
FIG. 3*c* shows deformation of the plate of the embodiment of FIGS. 2*b* and 3*b* in the event of maximum retreat of the rotor stage placed upstream.

In reference to FIG. 3*c*, this shows deformation of the plate 30 in case of overspeed of the rotor causing abnormal displacement of the latter. It is clear that the plate does not make contact with the exhaust casing due to its geometry detailed hereinabove.

The invention claimed is:

1. An assembly comprising:

an exhaust casing configured to surround an axis (X-X) of a turbine engine drive shaft, said exhaust casing including:

a fastening flange, an exhaust casing support coupled to the fastening flange, a sealing plate attached to the fastening flange with a radial section having:

a radially internal end part, a radially external end part, and an elbow extending between the radially internal end part and the radially external end part, said elbow angularly open towards the exhaust casing, wherein the radially external end part;

a) is orientated relative to the radially internal end part at an angle between 80 and 100 degrees, b) has a length in an axial direction between 15 and 35% of the height of the sealing plate measured in a radial direction around the axis of the turbine engine drive shaft, and c) extends substantially parallel to the axis of the turbine engine drive shaft.

2. The assembly according to claim 1, wherein the radially external end part is orientated relative to the radially internal end part with an angle of 90 degrees, the radially internal end part extending substantially radially relative to the axis of the turbine engine drive shaft.

3. The assembly according to claim 1, wherein the elbow is a first elbow, and the sealing plate further comprises an intermediate part, the first elbow connecting the radially external end part and the intermediate part together, and a second elbow connecting the intermediate part and the radially internal end part together, and the radially internal end part has a length between 25 and 45% of the height of the sealing plate measured in the radial direction around the axis of the turbine engine drive shaft.

4. The assembly according to claim 3, wherein the radially external end part in the axial direction of the plate has a mid-point substantially aligned with the radially internal end part.

5. The assembly according to claim 3, wherein the intermediate part of the sealing plate comprises:

a radially internal portion, a radially external portion, and a third elbow connecting together the radially internal and external portions, the first elbow and the second elbow being open towards a same side of the plate relative to the axis, and the third elbow being open towards an opposite side of the sealing plate, wherein the external end part is oriented relative to the external portion of the intermediate part with an angle comprised between 5 and 15 degrees, and of the radially external portion of the intermediate part with an angle between 60 and 80 degrees.

6. The assembly according to claim 5, wherein the distance, measured in the axial direction, between the first elbow and the radially internal end part, corresponds substantially to a quarter of the distance, measured in the axial direction, between the first and the third elbow.

7. The assembly according to claim 5, wherein the casing comprises a protruding spoiler extending parallel to the axis, said protruding spoiler disposed upstream of the casing relative to the airflow, the third elbow of the plate being disposed downstream of the spoiler relative to the airflow.

8. The assembly according to claim 1, wherein the exhaust casing is configured to be fixed to the casing support by the fastening flange, and the sealing plate is fixed between the fastening flange and the casing support.

9. The assembly according to claim 1, wherein the height of the plate is between 15 and 35% of the distance between the axis of revolution and the radially external end part of the sealing plate.

10. A turbine engine, comprising an assembly, according to claim 1.

* * * * *